US009382921B2

(12) United States Patent
Eriksson et al.

(10) Patent No.: US 9,382,921 B2
(45) Date of Patent: Jul. 5, 2016

(54) CONTROL OF SUBSEA COMPRESSORS

(75) Inventors: Klas Goran Eriksson, Asker (NO); Geir Inge Olsen, Oslo (NO); Kjell Olav Stinessen, Oslo (NO)

(73) Assignee: Aker Subsea AS, Lysaker (NO)

( * ) Notice: Subject to any disclaimer, the term of this patent is extended or adjusted under 35 U.S.C. 154(b) by 234 days.

(21) Appl. No.: 13/518,030

(22) PCT Filed: Dec. 20, 2010

(86) PCT No.: PCT/NO2010/000477

§ 371 (c)(1),
(2), (4) Date: Jun. 21, 2012

(87) PCT Pub. No.: WO2011/081528

PCT Pub. Date: Jul. 7, 2011

(65) Prior Publication Data

US 2012/0257990 A1 Oct. 11, 2012

(30) Foreign Application Priority Data

Dec. 29, 2009 (NO) ..... 20093599

(51) Int. Cl.
*F04D 31/00* (2006.01)
*F04D 13/08* (2006.01)
(Continued)

(52) U.S. Cl.
CPC ..... *F04D 31/00* (2013.01); *F04D 13/08* (2013.01); *F04D 25/0686* (2013.01); *F04D 27/009* (2013.01); *F04D 29/705* (2013.01); *F04D 27/0223* (2013.01); *F04D 27/0292* (2013.01)

(58) Field of Classification Search
CPC . F04D 15/0005; F04D 15/0077; F04D 15/02; F04D 27/0292; F04D 31/00; F04D 29/70; F04D 29/701; F04D 29/705; F04D 29/706; F04D 29/063; F04D 13/08; F04D 13/086; F04D 25/0686; F04D 27/009; F04D 27/0207; F04D 27/0223–27/0238; F04D 15/0209–15/0218; E21B 43/36; E21B 43/40
USPC ..... 417/4, 6, 20, 63, 138, 13, 26, 279; 166/105.5, 357, 267; 95/24, 245, 254, 95/258, 1, 149, 187; 356/335, 336, 441
See application file for complete search history.

(56) References Cited

U.S. PATENT DOCUMENTS 3,766,747 A * 10/1973 Parker ..... F04B 35/04 417/13
5,256,171 A * 10/1993 Payne ..... B01D 19/0057 95/157

(Continued)

FOREIGN PATENT DOCUMENTS

EP 1159599 A1 12/2001
EP 2093429 A1 8/2009

(Continued)

OTHER PUBLICATIONS

Wilhelmsen, John André, "International Search Report" for PCT/NO2010/000477, as mailed Mar. 24, 2011, 3 pages.

*Primary Examiner* — Alexander Comley
(74) *Attorney, Agent, or Firm* — Winstead PC

(57) ABSTRACT

System for control of a subsea located compressor fluidly connected to receive an inlet flow of gas through an inlet line, said flow may include liquid in an amount that may vary. The control system comprises a sensor means for measuring and determining the liquid droplet size distribution and liquid volume fraction, operatively arranged to the inlet line, and a control means operatively connected to the sensor means for operation of the control means based on input from the sensor means. Method for control of a subsea located compressor.

4 Claims, 2 Drawing Sheets

(51) Int. Cl.

| | |
|---|---|
| ***F04D 25/06*** | (2006.01) |
| ***F04D 27/00*** | (2006.01) |
| ***F04D 29/70*** | (2006.01) |
| *F04D 27/02* | (2006.01) |

(56) References Cited

U.S. PATENT DOCUMENTS

| | | | | | |
|---|---|---|---|---|---|
| 5,335,728 | A * | 8/1994 | Strahan | E21B 43/34 | 166/267 |
| 5,351,756 | A * | 10/1994 | Minkkinen | E21B 37/06 | 166/267 |
| 5,393,202 | A * | 2/1995 | Levallois | E21B 43/12 | 417/19 |
| 5,490,562 | A * | 2/1996 | Arnold | B01D 19/0068 | 166/267 |
| 5,544,672 | A * | 8/1996 | Payne | B01D 19/0063 | 137/1 |
| 5,815,264 | A * | 9/1998 | Reed | G01N 21/53 | 250/574 |
| 5,851,293 | A * | 12/1998 | Lane | B01D 53/74 | 118/715 |
| 6,039,116 | A * | 3/2000 | Stevenson | E21B 43/16 | 166/105.5 |
| 6,153,873 | A * | 11/2000 | Wolf | G01N 15/0205 | 250/208.1 |
| 6,296,060 | B1 * | 10/2001 | McCaslin | E21B 41/005 | 166/267 |
| 6,341,615 | B1 * | 1/2002 | Zorich | B01D 45/00 | 137/14 |
| 6,888,631 | B2 * | 5/2005 | Eriksson | G01N 15/0227 | 356/335 |
| 8,025,100 | B2 * | 9/2011 | Dehaene | E21B 43/124 | 166/265 |
| 8,771,394 | B2 * | 7/2014 | Skofteland | E21B 43/36 | 55/385.1 |
| 2003/0010502 | A1 * | 1/2003 | Poorte | F04D 31/00 | 166/373 |
| 2004/0159437 | A1 * | 8/2004 | Choi | E21B 43/01 | 166/335 |
| 2004/0245182 | A1 * | 12/2004 | Appleford | E21B 43/121 | 210/739 |
| 2006/0151167 | A1 * | 7/2006 | Aarvik | E21B 43/00 | 166/267 |
| 2007/0029091 | A1 * | 2/2007 | Stinessen | E21B 43/36 | 166/357 |
| 2009/0050326 | A1 * | 2/2009 | Grynning | B08B 9/00 | 166/312 |
| 2009/0321366 | A1 * | 12/2009 | Poorte | F17D 1/005 | 210/747.5 |
| 2011/0048546 | A1 * | 3/2011 | Bjorge | E21B 43/01 | 137/154 |
| 2012/0055335 | A1 * | 3/2012 | Mateman | F04D 13/12 | 95/153 |

FOREIGN PATENT DOCUMENTS

| | | | | |
|---|---|---|---|---|
| EP | 2093429 | A1 * | 8/2009 | F04D 17/12 |
| GB | 2371858 | A | 8/2002 | |
| NO | 327253 | B1 | 5/2009 | |
| NO | 20093598 | A | 6/2011 | |
| WO | WO-00/46586 | A1 | 8/2000 | |
| WO | WO 0046586 | A1 * | 8/2000 | |
| WO | WO 2008004882 | A1 * | 1/2008 | F17D 1/00 |
| WO | WO-2011080216 | A1 | 7/2011 | |

* cited by examiner

CONTROL OF SUBSEA COMPRESSORS

FIELD OF THE INVENTION

The present invention relates to compressors. More specifically, the present invention relates to a subsea located compressor that can operate in order to compress gas provided a liquid contents in the gas inlet flow is below a maximum limit.

BACKGROUND OF THE INVENTION AND PRIOR ART

Compressors are well known technology having numerous applications. It is also known that compressors will be damaged if the compressor blades, rotating at high speed, are hit by heavy objects. Such heavy objects include excessive quantities of oil drops and water drops. Accordingly, a compressor can only operate reliably if the liquid contents of the gas to be compressed is within a maximum acceptable limit.

For compressors operating on dry sites, such as industrial sites, the liquid contents can be separated out from the inlet gas. The separated liquid can be used for any convenient purpose or be discharged after being cleaned if required.

For a compressor located subsea, neither of separation, use and discharge of the liquid is straightforward. The actual location of the compressor can be tens or hundreds of kilometers away from land or surface installations and the depth can be hundreds of meters. Use of the separated liquid, typically oil and possibly water, requires huge investments in equipment and pipes. Discharge of the oil will violate regulations. The equipment for subsea separation and cleaning is very expensive. Currently, collection of sample bottles with an ROV (remotely operated vehicle) and nuclear density gauges are the techniques for determination of liquid in gas volume fraction. The above mentioned high cost and limited availability of technology are disadvantages of the prior art subsea compression technology.

There is a demand for both a system and a method for control of a subsea located compressor, providing improvements with respect to the disadvantages mentioned above.

SUMMARY OF THE INVENTION

The demand is met with the present invention.

More specifically, the invention provides a system for control of a subsea located compressor fluidly connected to receive an inlet flow of gas through an inlet line, said flow may include liquid in an amount that may vary. The control system comprises

- a sensor means for measuring and determining the liquid droplet size distribution and liquid volume fraction, operatively arranged to the inlet line, and
- a control means operatively connected to the sensor means for operation of the control means based on input from the sensor means.

In a preferable embodiment the system comprises:

- a sensor means for measuring and determining the liquid droplet size distribution and liquid volume fraction, operatively arranged to the inlet line, and
- a control means for control of the inlet flow, operatively arranged to the inlet line upstream of the sensor means, said control means is operatively connected to the sensor means for operation of the control means based on input from the sensor means.

The sensor means is preferably an optical sensor using dark-field illumination with objective and camera arranged between a multitude of light sources, arranged outside of or including a window to be arranged in the pipe wall. The sensor is the subject matter of parallel patent application NO 2009 3598 to which it is referred for further information. Alternatively, the sensor is according to the teaching of EP 1159599.

The control means preferably comprises at least one of an atomiser or injection mixer or ejector; a gas scrubber or separator further upstream separating and retaining liquid contents from the inlet flow, and a line arranged for injecting and mixing retained liquid back into the inlet flow, via the atomiser or injection mixer or ejector, as small droplets of size distribution and liquid volume fraction within a maximum acceptable limit, a switch or speed control operatively connected to the subsea compressor. Accordingly, the control means can stop or reduce the speed of the compressor, or the control means can affect the droplet size distribution and liquid volume fraction of the inlet line to the compressor. Preferably, the atomiser or injection mixer uses the venturi effect in order to draw in liquid. The injection mixer can be a ProPure injection mixer. Preferably a line with high pressure gas from the outlet side of the compressor is fed back to the injection mixer or atomiser in order to draw in liquid and achieve a good mixing or atomisation. An injection pump and a control valve are preferably arranged in the line for liquid from the scrubber or separator.

Preferably a scrubber is arranged in the inlet line, a liquid level sensor is arranged in the scrubber, a gas outlet from the scrubber includes an atomiser or injection mixer upstream of a sensor means in the inlet line to the compressor, the atomiser or injection mixer is operatively connected to a control device and the atomiser or injection mixer is fluidly connected to the outlet side of the compressor and to a liquid outlet from the scrubber.

Preferably, the atomiser or injection mixer is arranged immediately upstream of the compressor, for example within a distance of two inlet pipe diameters, with only the sensor in between the compressor and atomiser or injection mixer. This is preferable in order to avoid coalescence or similar effect by the droplets and avoid precipitation of droplets on surfaces before reaching the compressor.

Preferably, the gas inlet line includes a flow rate and/or flow velocity meter, which makes it easier to relate the droplet size distribution and the liquid volume fraction to the impact effect of the liquid contents on the compressor, and improves the quality of the calculations. Preferably, the flow meter is integrated as a venturi flow meter as a part of the injection mixer or atomiser. A separate measurement of flow rate, combined with the measurements of the optical darkfield sensor of droplet size and thereby droplet size distribution and liquid volume fraction or droplet density, facilitates the processing of the measured data in order to calculate the impact effect of the liquid contents, in order to ensure that the liquid contents is below the acceptable limit. Alternatively, the parameters are calculated only based on data from the darkfield sensor, for example by taking many representative droplet pictures, thereby finding liquid volume fraction, and determining droplet movement as a function of time, thereby finding flow rate and velocity.

The invention also provides a method for control of a subsea located compressor fluidly connected to receive an inlet flow of gas through an inlet line, said flow may include liquid in an amount that may vary. The method comprises

- measuring and/or determining the liquid droplet size distribution and liquid volume fraction by using a sensor means operatively arranged to the inlet line, and operating the subsea compressor or control means or equipment upstream of the compressor based on input of the sensor means.

The method preferably comprises the step:

operating a control means arranged to the inlet line upstream of the sensor means, based on input form the sensor means, so as to ensure that the liquid contents of the inlet flow is within a maximum acceptable limit.

The amount of liquid that a compressor can operate with depends on the droplet size. As large droplets have higher momentum than small droplets, they cause more damage. Field tests have shown that a compressor can operate with several percent of liquid content indefinitely as long as the droplet size is very small. This is indicated principally in FIG. 1. As the momentum of each droplet also depends on the gas velocity, this also needs to be taken into account. If the gas velocity is not available, a default value is used instead in the calculations.

Normally there will be a range of droplet sizes present. From the sensor signals, droplet size statistics are collected for a number of droplets. The statistics are divided into size groups. The statistics are then further converted into momentum using the gas velocity, and for each group it is verified that the concentration does not exceed the allowed maximum limit from FIG. 1. The distributed droplet size fractions are preferably summarized to 1 or below, whereby 1 denotes the maximum allowable amount for a specific droplet size.

Preferably, liquid is retained in a scrubber upstream of the sensor means, at excessive liquid level in the scrubber liquid is injected into the inlet line via an atomiser or injection mixer between the scrubber and sensor means, the liquid is drawn into the atomiser or injection mixer by the venturi effect. Preferably high pressure gas from the outlet side of the compressor, as delivered through a line from the compressor outlet line to the atomiser or injection mixer, preferably with a control valve in the line, is used to facilitate drawing in liquid. Pumping is preferably an additional, supplementary or replacing way of injecting liquid into the inlet flow to the compressor.

The invention also provides use of an optical dark field sensor for measuring and determining the liquid droplet size distribution and liquid volume fraction upstream of a subsea compressor. Preferably, the measurement results are used for control of the subsea compressor or control means or equipment upstream of the compressor.

FIGURES

The invention is illustrated by two figures, of which

DETAILED DESCRIPTION

Figure 1:
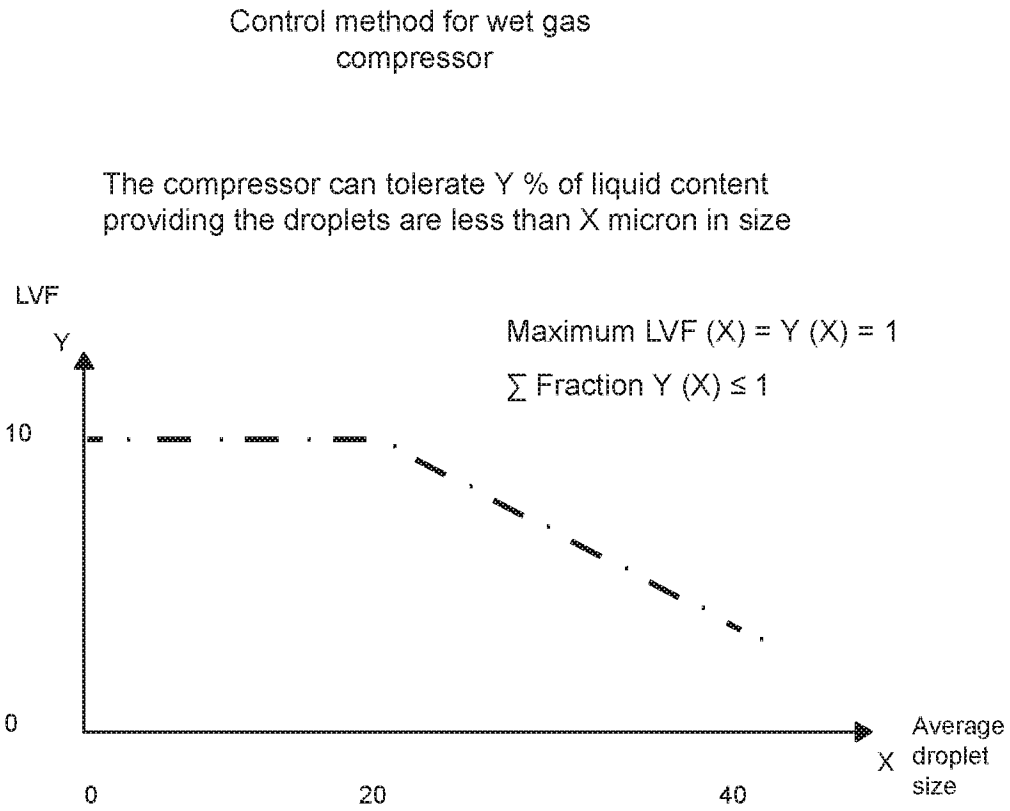
FIG. 1 illustrates the maximum allowable liquid contents.

Reference is made to FIG. 1, illustrating how the compressor can tolerate a liquid content for an average droplet size; the maximum limit is represented by a dotted line. For average droplet size below 20 micron, 10% liquid content can be tolerated, for larger average droplet sizes the maximum tolerable limit drops as a straight line. However, the droplets will typically have a distribution, but if the distribution and type of liquid is consistent, the model based on average droplet size is useful. Further, the velocity and flow rate in the inlet line to the compressor will also affect the maximum limit, but the speed of the compressor blades or rotors is very high compared to the velocity of the droplets, the directions of movement being perpendicular initially, which limits the effect of the velocity in the inlet pipe. Both droplet velocity and droplet size distribution are factors that should be paid particular attention if they vary outside appropriate limits, that is, if they vary so much that the operation is significantly affected.

Figure 2:
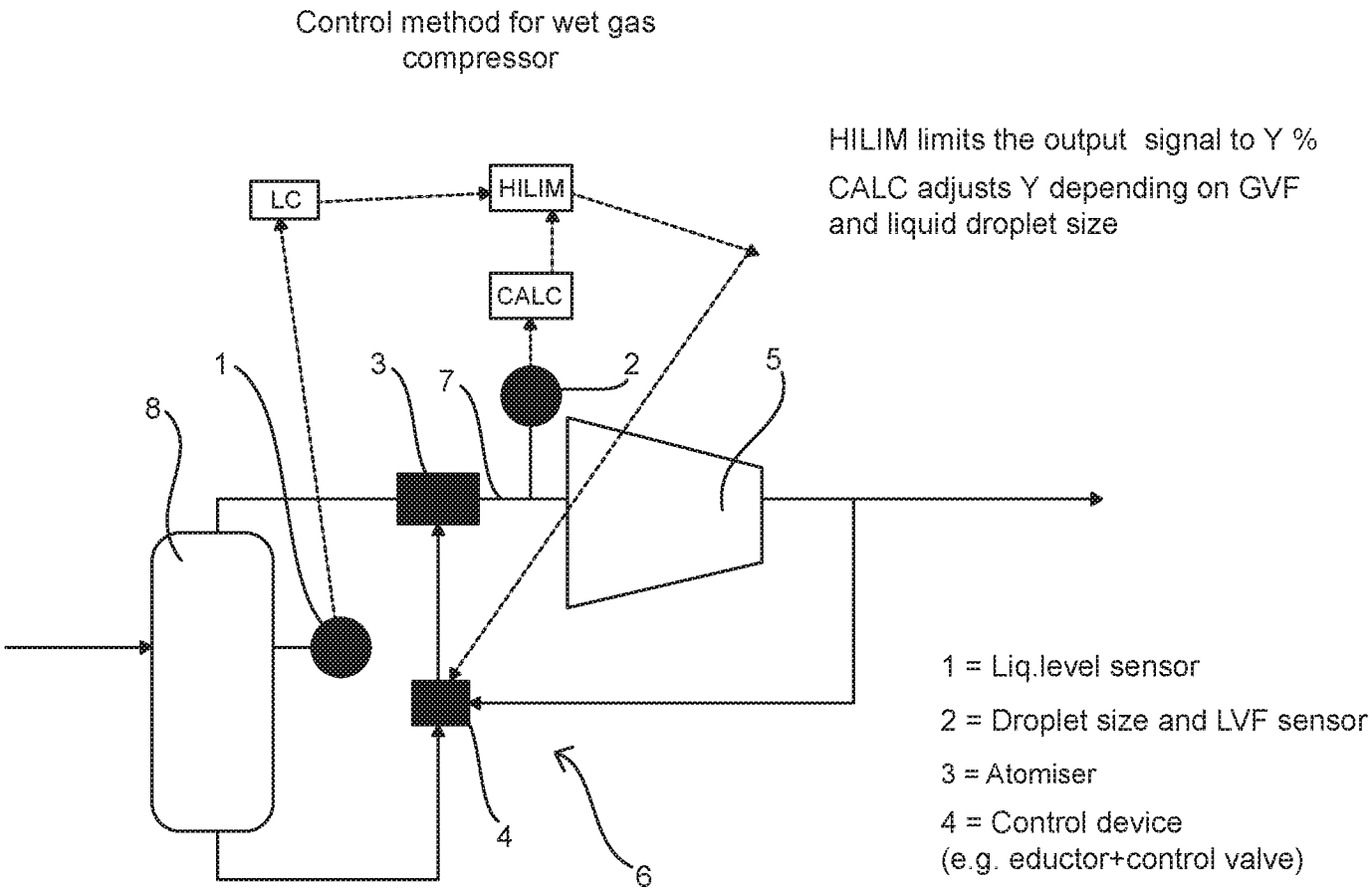
FIG. 2 illustrates an embodiment of the system of the invention.

Further reference is made to FIG. 2, illustrating a system of the present invention. More specifically, a system 6 for control of a subsea located compressor 5 fluidly connected to receive an inlet flow of gas through an inlet line 7 is illustrated, said flow may include liquid in an amount that may vary. The system comprises a sensor means 2 for measuring and determining the liquid droplet size distribution and liquid volume fraction, operatively arranged to the inlet line, and a control means 3,4 for control of the inlet flow, operatively arranged to the inlet line upstream of the sensor means, said control means is operatively connected to the sensor means for operation of the control means based on input from the sensor means. The illustrated control means comprises an atomiser 3, arranged in the inlet line 7, and an injection pump and/or control valve 4, and associated control units. The control element 4 may also be an ejector or eductor type device, with modulating control via a control valve in the gas line. Also a scrubber 8 with a level sensor 1 is illustrated. A liquid outlet line is arranged from a bottom level of the scrubber to the injection pump 4 and/or control valve 4. A line for supply of high pressure gas is arranged from the outlet side of the compressor to the control valve 4. The liquid from the bottom of the scrubber and the high pressure gas from the outlet side of the compressor are transferred independently but in parallel lines from the control means 4 to the atomiser 3, where said liquid is broken up to droplets of microns sizes, aided by the turbulence generated with the high pressure gas. The injection rate of liquid and the feedback flow of high pressure gas are regulated by injection pump 4 and control valve 4, respectively, which units are illustrated as one unit on FIG. 2. The line transferring liquid may in addition to or as a replacement to the injection pump include a injection control valve. However, a PID level controller LC, taking input from level sensor 1 at the scrubber, has a fixed level setpoint. If the level exceeds this setpoint, an output signal increases, which increase results in energising the injection pump 4 for transfer of accumulated liquid back into the gas inlet line via the atomiser 3. Accordingly, the accumulated liquid is reinjected into the inlet flow, the mixing and dispersion into droplets of micron sizes are facilitated by the reflux or feedback flow of high pressure gas from the outlet side of the compressor. However, the sensor 2 measures the average droplet size, the droplet size distribution and the liquid volume fraction. A calculation ("CALC") element determines, based on input from the sensor, whether the compressor operates safely or beyond the maximum acceptable limit of liquid contents. If the operation is beyond the limit, based on input from the CALC element, a high limit of the measured parameter ("HILM") element will reduce the reinjection of liquid by reducing the signal to the control means 4. Alternatively no high pressure gas is fed back to the injection mixer or atomiser, in which case only an injection pump may be sufficient in the liquid reinjection line, in addition to associated control units.

The system of the invention can be combined with features as described or illustrated in this document in any operative combination, which combinations are embodiments of the present invention. The method of the invention can be combined with features as described or illustrated in this document in any operative combination, which combinations are embodiments of the present invention. The use of the invention can be combined with features as described or illustrated in this document in any operative combination, which combinations are embodiments of the present invention.

The invention claimed is:

1. A system for control of a subsea located compressor fluidly connected to receive an inlet flow of gas through an inlet line, said inlet flow includes liquid in an amount that may vary, the system comprising:

a scrubber having a first fluid line to an atomiser and a second fluid line to a control valve, the control valve being fluidly coupled to the atomiser;

a compressor fluidly coupled to the atomiser;

an optical sensor, operatively coupled to the inlet line serially between the atomiser and the compressor, the optical sensor measures and determines a liquid droplet size distribution and a liquid volume fraction; and a control means operatively connected to the optical sensor; and wherein the control valve injects, via the atomizer, fluid into an inlet of the compressor responsive to a liquid level as measured by a liquid-level sensor and responsive to a liquid droplet size distribution and liquid volume fraction as measured by the optical sensor.

2. The system according to claim 1, wherein the optical sensor utilizes dark-field illumination with an objective and a camera arranged between a multitude of light sources, and arranged outside of or including a window to be arranged in a wall of the inlet line.

3. The system according to claim 1, wherein:

the control means comprises at least one of the atomiser or an injection mixer, and the scrubber or a separator disposed upstream that separates and retains liquid contents from the inlet flow; and a line arranged for injecting and mixing retained liquid back into the inlet flow, via the atomiser or injection mixer, as small droplets of size distribution and liquid volume fraction within a maximum acceptable limit.

4. The system according to claim 1, wherein: the scrubber is arranged in the inlet line; the liquid level sensor is arranged in the scrubber; a gas outlet from the scrubber includes the atomiser or an injection mixer upstream of the optical sensor in the inlet line to the compressor; and the atomiser or the injection mixer is operatively connected to a control device and the atomiser or the injection mixer is fluidly connected to an outlet side of the compressor and to a liquid outlet from the scrubber.

* * * * *